US007789697B2

(12) United States Patent
Fiennes

(10) Patent No.: US 7,789,697 B2
(45) Date of Patent: Sep. 7, 2010

(54) PLUG DETECTION MECHANISMS

(75) Inventor: Hugo Fiennes, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/156,396

(22) Filed: May 29, 2008

(65) Prior Publication Data

US 2008/0305676 A1 Dec. 11, 2008

Related U.S. Application Data

(60) Provisional application No. 60/934,234, filed on Jun. 11, 2007.

(51) Int. Cl.
*H01R 3/00* (2006.01)

(52) U.S. Cl. ..... 439/489; 439/188

(58) Field of Classification Search ..... 439/489, 439/188, 668, 669, 490, 955; 200/51.1
See application file for complete search history.

(56) References Cited

U.S. PATENT DOCUMENTS 3,852,703 A * 12/1974 Carney et al. ..... 439/372
4,367,907 A * 1/1983 Buck ..... 439/188
4,392,708 A * 7/1983 Bailey et al. ..... 439/668
4,548,447 A * 10/1985 Dinsmore ..... 439/43
4,658,212 A * 4/1987 Ozawa et al. ..... 324/754
4,758,536 A * 7/1988 Miller et al. ..... 439/138
4,770,639 A * 9/1988 Lau ..... 439/61
4,840,568 A * 6/1989 Burroughs et al. ..... 439/49
4,954,096 A * 9/1990 Frank ..... 439/346
4,975,087 A * 12/1990 Williams et al. ..... 439/668
5,145,416 A * 9/1992 Cruise et al. ..... 439/668
5,170,327 A * 12/1992 Burroughs ..... 361/728
5,393,249 A * 2/1995 Morgenstern et al. ..... 439/668
5,429,519 A * 7/1995 Murakami et al. ..... 439/310
5,634,822 A * 6/1997 Gunell ..... 439/668
5,831,438 A * 11/1998 Okura ..... 324/538
5,938,478 A * 8/1999 Werner ..... 439/668
6,116,935 A * 9/2000 Fukuda ..... 439/310
6,123,575 A * 9/2000 Huang et al. ..... 439/489
6,422,902 B1 * 7/2002 Ogren et al. ..... 439/668
6,835,080 B1 * 12/2004 Chang ..... 439/188
6,855,003 B1 * 2/2005 Wyant ..... 439/502
6,866,527 B2 * 3/2005 Potega ..... 439/218
6,869,316 B2 * 3/2005 Hinkle et al. ..... 439/675
6,945,803 B2 * 9/2005 Potega ..... 439/218
6,981,887 B1 * 1/2006 Mese et al. ..... 439/244
7,083,475 B2 * 8/2006 Henneberger et al. ..... 439/668
7,128,591 B2 * 10/2006 Tsai ..... 439/188
7,150,641 B2 * 12/2006 Tsai ..... 439/188
7,234,974 B2 * 6/2007 Henneberger et al. ..... 439/668

(Continued)

*Primary Examiner*—T C Patel
*Assistant Examiner*—Vladimir Imas
(74) *Attorney, Agent, or Firm*—Blakely, Sokoloff, Taylor & Zafman LLP

(57) ABSTRACT

Plug detection mechanisms can be provided for detecting when a plug of an accessory component is present within a jack of an electronic device. A detect contact and a jack contact may be positioned within a receptacle of the jack such that a signal path may be created through the plug and between the detect contact and the jack contact when the plug is present within the receptacle of the jack. The detect contact may be biased to exert a retention force on the plug. The detect contact may be positioned to contact the plug within an indent of the plug.

29 Claims, 5 Drawing Sheets

U.S. PATENT DOCUMENTS

| | | | | |
|---|---|---|---|---|
| 7,241,157 | B2 * | 7/2007 | Zhuang et al. | 439/188 |
| 7,247,046 | B1 * | 7/2007 | Wu | 439/490 |
| 7,316,588 | B1 * | 1/2008 | Rogers et al. | 439/668 |
| 7,316,589 | B1 * | 1/2008 | Rogers et al. | 439/668 |
| 7,322,858 | B1 * | 1/2008 | Rogers et al. | 439/669 |
| 7,495,188 | B2 * | 2/2009 | Follingstad et al. | 200/51 R |
| 7,503,807 | B2 * | 3/2009 | Martin et al. | 439/638 |
| 2001/0055905 | A1 * | 12/2001 | Tezuka | 439/488 |
| 2005/0191887 | A1 * | 9/2005 | Hsieh | 439/188 |
| 2006/0183368 | A1 * | 8/2006 | Kim | 439/502 |
| 2007/0218774 | A1 * | 9/2007 | Han et al. | 439/668 |
| 2009/0061694 | A1 * | 3/2009 | Kawasaki et al. | 439/669 |

* cited by examiner

PLUG DETECTION MECHANISMS

CROSS-REFERENCE TO RELATED APPLICATION

This claims the benefit of U.S. Provisional Application No. 60/934,234, filed Jun. 11, 2007, which is hereby incorporated by reference herein in its entirety.

FIELD OF THE INVENTION

This can relate to systems for detecting when a plug of an accessory component is present within a jack of an electronic device.

BACKGROUND OF THE DISCLOSURE

There is a need for determining when a plug of an accessory component is present within a jack of an electronic device. Specifically, there is a need for reliably determining when a plug of an accessory component is present within a jack of an electronic device that is configured to alter its function based on whether such a plug is present.

Accordingly, what is needed are systems for reliably detecting when a plug of an accessory component is present within a jack of an electronic device.

SUMMARY OF THE DISCLOSURE

Systems for detecting when a plug of an accessory component is present within a jack of an electronic device are provided.

According to an embodiment of the invention, a plug detect apparatus for detecting the presence of a plug is provided, wherein the plug has at least a first plug contact. The plug detect apparatus includes a receptacle configured to accept the plug. The plug detect apparatus also includes a first receptacle contact disposed in the receptacle, wherein the first receptacle contact is configured to communicate with the first plug contact. The plug detect apparatus also includes a detect contact disposed in the receptacle, wherein the presence of the plug within the receptacle creates a signal path through the plug and between the detect contact and the first receptacle contact.

According to another embodiment of the invention, an electronic device capable of detecting the presence of a plug of an accessory component is provided, wherein the plug includes a first plug contact. The electronic device includes a receptacle configured to accept the plug. The electronic device also includes a first receptacle contact disposed in the receptacle, wherein the first receptacle contact is configured to communicate with the first plug contact. The electronic device also includes a detect contact disposed in the receptacle, wherein the presence of the plug within the receptacle creates a plug signal path through the plug and between the detect contact and the first receptacle contact. The electronic device may also include a first input/output component as well as control circuitry coupled to the detect contact. The control circuitry of the electronic device may be configured to instruct the electronic device to utilize the first input/output component when a detect signal on the detect contact has a first value. The control circuitry of the electronic device may also be configured to instruct the electronic device to utilize the accessory component when the detect signal has a second value.

BRIEF DESCRIPTION OF THE DRAWINGS

The above and other features of the invention, its nature and various advantages will become more apparent upon consideration of the following detailed description, taken in conjunction with the accompanying drawings, in which like reference characters refer to like parts throughout, and in which.

DETAILED DESCRIPTION OF THE DISCLOSURE

Systems for detecting when a plug of an accessory component is present within a jack of an electronic device are provided and described with reference to FIGS. 1-5.

Figure 1:
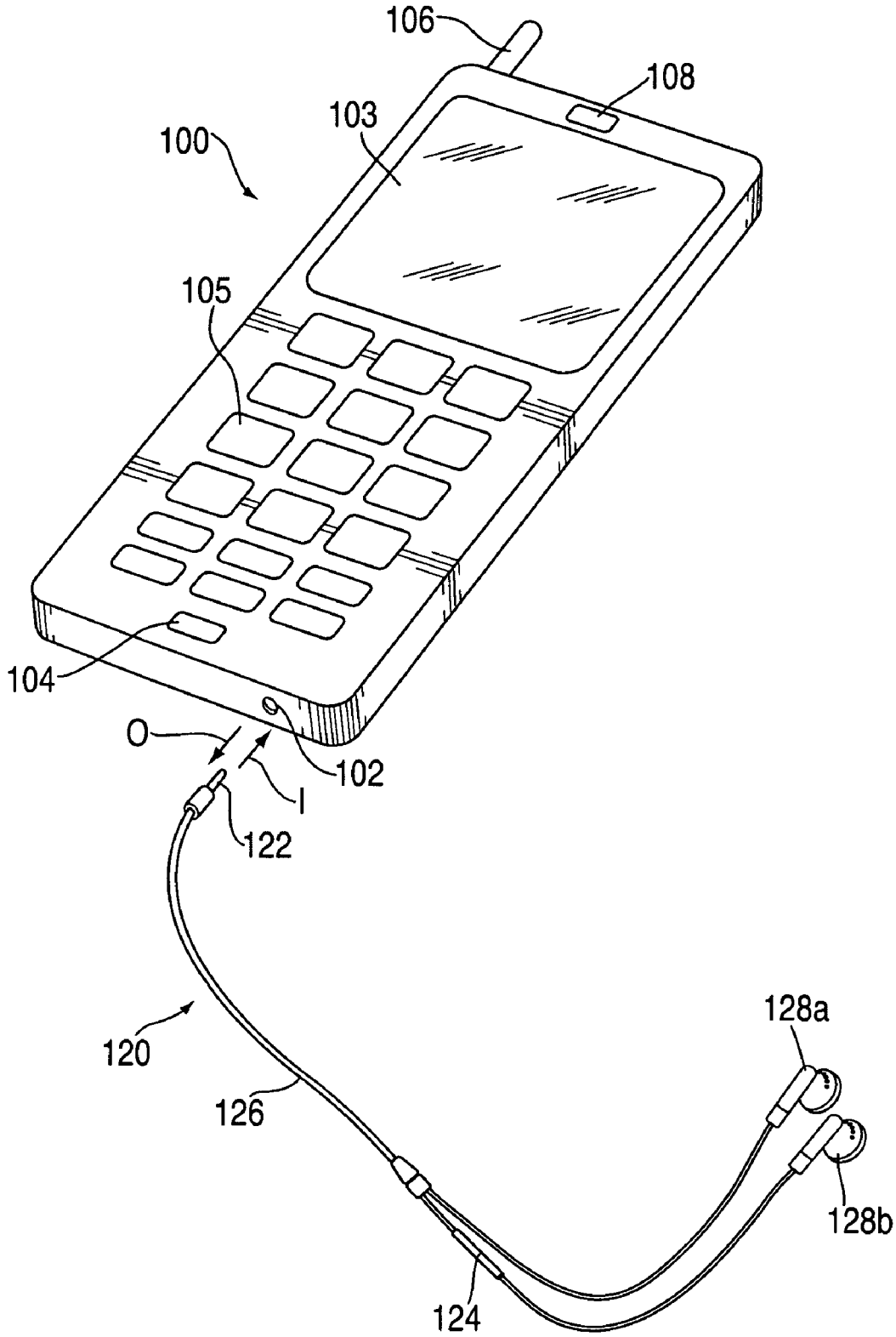
FIG. 1 is a perspective view of an electronic device and a corresponding accessory component in accordance with the invention.

FIG. 1 shows a perspective view of an illustrative electronic device 100 that may include a socket or jack 102 with a plug detection mechanism for detecting when a plug 122 of an accessory component 120 is present within jack 102. Electronic device 100 may be any electronic device, such as, but not limited to, a music player, video player, still image player, game player, other media player, music recorder, video recorder, camera, other media recorder, radio, medical equipment, calculator, cellular telephone, other wireless communication device, personal digital assistant, remote control, pager, laptop computer, desktop computer, printer, or combinations thereof. In some cases, the electronic device may perform a single function (e.g., an electronic device dedicated to receiving and transmitting telephone calls) and, in other cases, the electronic device may perform multiple functions (e.g., an electronic device that plays music, displays video, stores pictures, and receives and transmits telephone calls).

In some case, electronic device 100 may generally be any portable, mobile, hand-held, or miniature electronic device with a jack capable of receiving and detecting a plug of an accessory device so as to allow a user to use the accessory in conjunction with the electronic device. Miniature personal electronic devices may have a form factor that is smaller than that of hand-held personal electronic devices, such as an iPod™ available by Apple Inc. of Cupertino, Calif. Illustrative miniature personal electronic devices can be integrated into various objects that include, but are not limited to, watches, rings, necklaces, belts, accessories for belts, headsets, accessories for shoes, virtual reality devices, other wearable electronics, accessories for sporting equipment, accessories for fitness equipment, key chains, or any combination thereof. Alternatively, electronic devices of the invention that include a jack capable of receiving and detecting a plug of an accessory device may not be portable at all.

Accessory component 120 may be any component that can be coupled to and used in conjunction with electronic device 100, such as, but not limited to, audio speakers, headphones, a video display, microphone, or combinations thereof. In some cases, the accessory component may perform a single function (e.g., an accessory dedicated to capturing audio signals and passing them on to electronic device 100) and, in other cases, the accessory component may perform multiple functions (e.g., an accessory that captures audio signals to pass on to the electronic device, as well as an accessory that receives audio signals from the electronic device and amplifies them for a user). Electronic device 100 is illustrated in FIG. 1 to be a cellular telephone, although it is to be understood that electronic device 100 may be any type of electronic device as described herein in accordance with the invention. Moreover, accessory component 120 is illustrated in FIG. 1 to be a headset, although it is to be understood that accessory component 120 may be any type of accessory component as described herein in accordance with the invention.

Electronic device 100, which is illustrated as a cellular telephone in FIG. 1, may include a housing 101, an output component 103, a user input component 105, and an external antenna 106. Output component 103 may be any suitable display for displaying media, including graphics, text, and video, to a user of electronic device 100. In some embodiments, output component 103 may be a touch screen display or a liquid crystal display ("LCD") screen. User input component 105 may allow a user to interact with electronic device 100. For example, user input component 105 can include one or more buttons, touchpads, touchscreens, scrollwheels, clickwheels, sliders, other appropriate input mechanisms, or any combination thereof. In some embodiments, output component 103 and user input component 105 can be combined (e.g., in a touchscreen or touch-sensitive display). Electronic device 100 also can be equipped with a built-in microphone 104 and a built-in speaker 108. Built-in speaker 108 can output audible sound to a user of device 100, while built-in microphone 104 can accept audible sound from the user. Output component 103, user input component 105, microphone 104, and speaker 108, either separately or in combination, may be referred to herein as an input/output ("I/O") component of electronic device 100.

Electronic device 100 also can be equipped with an accessory jack 102. Accessory jack 102 can be configured to accept a plug 122 from accessory component 120. Moreover, although not shown in FIG. 1, electronic device 100 can include various other components, such as a battery, a processor, memory, and the like for providing a properly functioning device.

Accessory component 120, which is illustrated as a headset in FIG. 1, may include a cable 126 extending between plug 122, a microphone 124, and earphones 128*a* and 128*b*. When accessory plug 122 is properly inserted into jack 102 of electronic device 100 in the direction of arrow I of FIG. 1, device 100 can be configured to output audible sound from earphones 128 of accessory 120 rather than, or as well as, from speaker 108 of device 100. Similarly, when accessory plug 122 is properly inserted into jack 102 of electronic device 100, device 100 can be configured to accept audible sound from microphone 124 of accessory 120 rather than, or as well as, from microphone 104 of device 100.

Figure 2A:
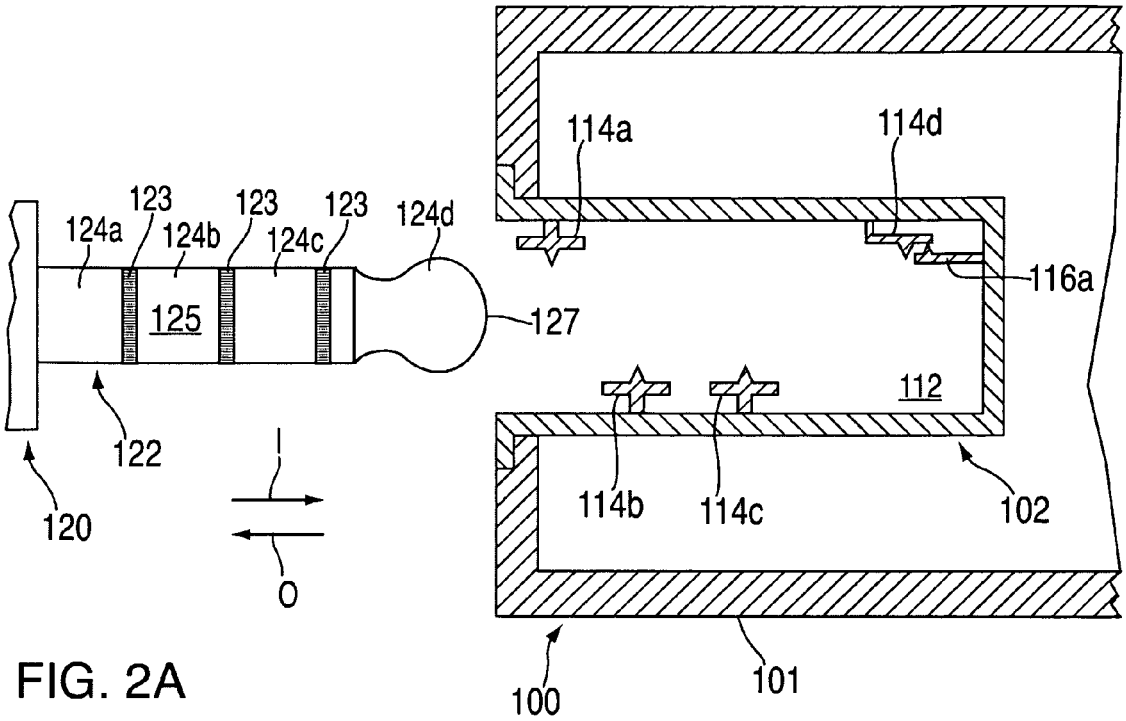
FIGS. 2A and 2B show a portion of the electronic device and accessory component of FIG. 1 in greater detail at various stages of interaction according to an embodiment of the invention.
Figure 2B:
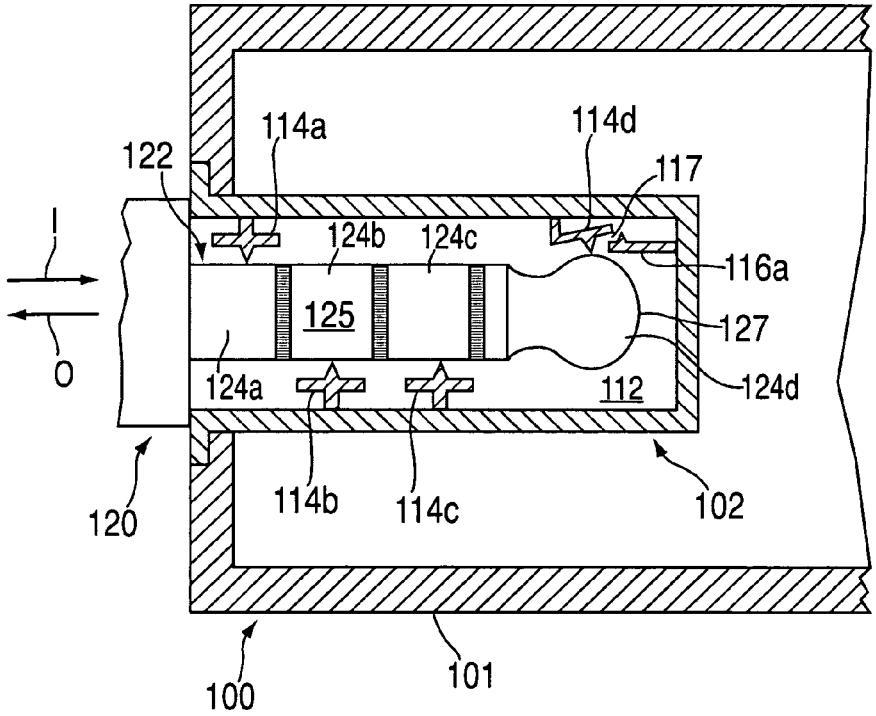

FIGS. 2A and 2B illustrate jack 102 of electronic device 100 and plug 122 of accessory component 120 in greater detail in accordance with one embodiment of the invention. Jack 102 can include a recess or receptacle 112 within which may be disposed one or more jack contacts 114 (e.g., four jack contacts 114*a*-114*d*). Accessory plug 120 can include one or more plug contacts 124 (e.g., four plug contacts 124*a*-124*d*) that may complement a respective one of the one or more jack contacts 114. Each one of jack contacts 114*a*-114*d* can be electrically isolated from each of the other adjacent jack contacts 114*a*-114*d* by being spaced apart within receptacle 112. Likewise, each one of plug contacts 124*a*-124*d* also can be electrically isolated from each of the other adjacent plug contacts 124*a*-124*d* by one or more insulators (e.g., insulator rings 123) spaced along the length of body 125 of plug 122.

When accessory plug 120 is inserted into receptacle 112 of jack 102 in the direction of arrow I, one or more plug contacts 124*a*-124*d* can come into contact (e.g., make electrical contact) with a respective one of the one or more jack contacts 114*a*-114*d*, as shown in FIG. 2B, for example. Along with other circuitry components of device 100 and accessory component 120 that are not shown, jack contacts 114 and plug contacts 124 can pass signals between electronic device 100 and accessory component 120 in order to affect the function of each other.

In one illustrative embodiment of the invention, plug contact 124*a* can pass signals from microphone 124 of accessory component 120 to electronic device 100 through jack contact 114*a* when plug contact 124*a* makes an electrical contact with jack contact 114*a*. Plug contact 124*b* and jack contact 114*b* can each act as ground. Jack contact 114*c* can pass signals from electronic device 100 to earphone 128*a* of accessory component 120 when plug contact 124*c* makes an electrical contact with jack contact 114*c*, and jack contact 114*d* can similarly pass signals from electronic device 100 to earphone 128*b* of accessory component 120 when plug contact 124*d* makes an electrical contact with jack contact 114*d*. Alternatively, jack contacts 114*a*-114*d* and plug contacts 124*a*-124*d* can be assigned to serve other roles. For example, contacts 114*d* and 124*d* can serve as ground while the remaining contacts can be functional contacts that pass functional signals to each other.

FIGS. 2A and 2B also illustrate a plug detection mechanism of electronic device 100 in accordance with one embodiment of the invention. To detect whether plug 122 has been disposed within receptacle 112 of jack 102, electronic device 100 can include an electrical and/or mechanical switch that is actuated when plug 122 is present within jack 102. For example, electronic device 100 can include a detect contact 116*a* in jack 102 to facilitate detection of plug 122. One of the contacts of jack 102 (e.g., jack contact 114*d*, as shown in FIGS. 2A and 2B) can be biased against detect contact 116*a* (e.g., using spring-loading) when no plug is present within receptacle 112 of jack 102.

However, when a plug is inserted into receptacle 112 of jack 102, a portion of the plug (e.g., tip 127 of plug 122 as shown in FIG. 2B) may contact and exert a force on biased jack contact 114*d*. This force exerted by plug 122 can move biased jack contact 114*d* away from detect contact 116*a*, thereby creating a gap 117 between biased jack contact 114*d* and detect contact 116*a*, as shown in FIG. 2B. Gap 117 may thereby open the circuit that had been previously established across jack contact 114*d* and detect contact 116*a* when they were biased against each other, as shown in FIG. 2A. This can cause a signal on detect contact 116*a* to go high (i.e., greater than or equal to a predetermined signal value), for example, which can be detected by a control unit of device 100, as described in more detail herein below with respect to FIG. 5. It is to be noted that in other embodiments, the plug detection mechanism may be configured such that the value of the signal on detect contact 116*a* can go low instead of high when gap 117 opens the circuit that had been previously established across jack contact 114*d* and detect contact 116*a* when they were biased against each other. Advantageously, because detect contact 116*a* may be electrically and/or mechanically isolated from one or more of jack contacts 114 when plug 122 is present within receptacle 112 of jack 102, as shown in FIG. 2B, detect contact 116*a* may not interfere with any signals passed between jack contacts 114 and plug contacts 124.

Figure 3A:
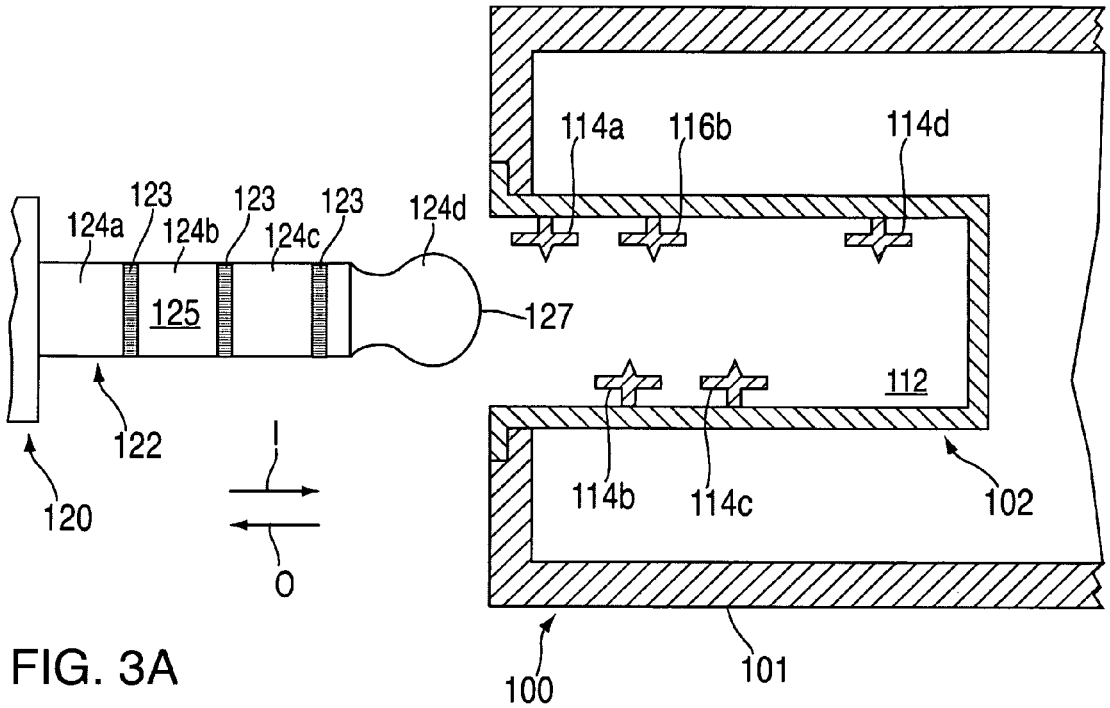
FIGS. 3A and 3B show a portion of the electronic device and accessory component of FIG. 1 in greater detail at various stages of interaction according to another embodiment of the invention.
Figure 3B:
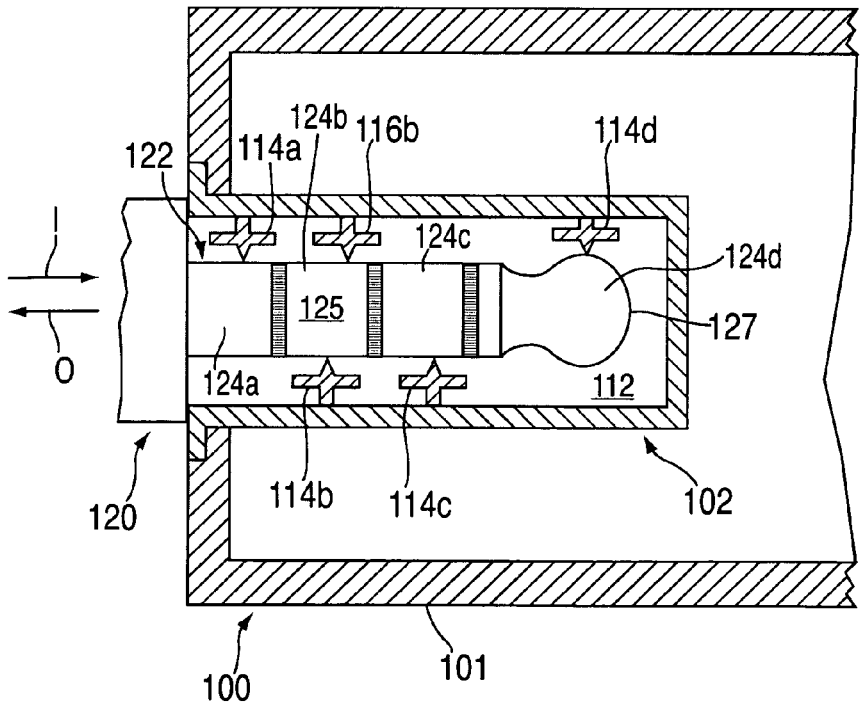

FIGS. 3A and 3B illustrate a plug detection mechanism of electronic device 100 in accordance with another embodiment of the invention. In this embodiment, to detect whether plug 122 has been inserted into and is present within receptacle 112 of jack 102, electronic device 100 can include a detect contact 116*b*. Detect contact 116*b* can be located within jack 102 such that one of plug contacts 124 of plug 122 can create a path (e.g., a low impedance circuit path) between detect contact 116*b* and one of jack contacts 114 when plug 122 is inserted into and present within receptacle 112 of jack 102. Body 125 of plug 122, which may be made at least partially of metal or another conductive material, can be used to form plug contacts 124, and can be used to complete a signal path or circuit between detect contact 116*b* and a respective jack contact 114.

For example, as shown in FIG. 3B, when plug 122 is inserted into and present within receptacle 112 of jack 102, a circuit signal path may be created through plug 122 (e.g., through plug contact 124*b*) and between detect contact 116*b* and jack contact 114*b*. This can cause a signal on detect contact 116*b* to go low (i.e., less than or equal to a predetermined signal value) if, for example, jack contact 114*b* is a ground jack contact (e.g., a contact coupled to ground). This low signal can then be detected by a control unit of device 100, as described in more detail herein below with respect to FIG. 5. However, in other embodiments, jack contact 114*b* may be a functional jack contact (e.g., a contact configured to pass variable audio signals between electronic device 100 and accessory component 120). The circuit signal path created through plug 122 and between detect contact 116*b* and a functional jack contact 114*b* when plug 122 is present within receptacle 112 may have a relatively higher impedance but may still be a low impedance circuit path. This signal can also be detected by a control unit of device 100, as described in more detail herein below with respect to FIG. 5. However, care may need to be taken such that the functional signal that may be passed by the functional jack contact is not adversely affected when the functional jack contact is also being used as the plug detect mechanism.

Advantageously, because detect contact 116*b* can be rubbed or wiped by plug 122 every time plug 122 is inserted into and/or removed from jack 102 (e.g., in the direction of arrows I and O, respectively), if debris collects on detect contact 116*b*, such debris can be cleaned off by plug 122 as it is inserted into or removed from jack 102. In comparison, the illustrative embodiment of FIGS. 2A and 2B may not permit accumulated debris to be as easily removed from detect contact 116*a*. For example, when debris (e.g., pocket lint or other miscellaneous debris prone to enter jack 102 of device 100) falls into receptacle 112, it can get lodged in between biased jack contact 114*d* and detect contact 116*a*, thereby preventing biased jack contact 114*d* from making electrical and/or mechanical contact with detect contact 116*a* when plug 122 is not present within jack 102. Because detect contact 116*a* can be disposed within electronic device 100 so that detect contact 116*a* does not touch plug 122 when plug 122 is present within jack 102, detect contact 116*a* may never be cleaned (e.g., may never be wiped) by plug 122 during its insertion into or removal from receptacle 112 of jack 102. Thus, accumulated debris can interfere with the functionality of the plug detect mechanism (e.g., detect contact 116*a* of jack 102) and electronic device 100 may always seemingly detect the presence of a plug within jack 102, even if there is not, due to gap 117 created by the debris lodged between detect contact 116*a* and biased jack contact 114*d*.

Therefore, if electronic device 100 includes detect contact 116*a* and is configured to change its functionality based on whether an accessory, such as accessory component 120, has been attached thereto by detecting whether an accessory plug is present within jack 102, electronic device 100 may constantly and often erroneously be engaged in an "accessory" mode due to uncleaned debris. However, by relocating the detect contact into the position of detect contact 116*b* of FIGS. 3A and 3B, such that it can contact plug 122 when plug 122 is present within receptacle 112 of jack 102, this potential problem can be rectified due to the ability of plug 122 to contact detect contact 116*b* and wipe any debris off of detect contact 116*b* or out from between detect contact 116*b* and jack contact 114*b* upon plug 122 being inserted into and/or removed from jack 102.

In one embodiment of the invention, detect contact 116*b* of FIGS. 3A and 3B can be disposed within jack 102 such that plug 122 can form a path between a jack contact 114 and detect contact 116*b* when plug 122 is present within receptacle 112. For example, in the illustrative embodiment of FIGS. 3A and 3B, jack contact 114*b* can serve as ground and detect contact 116*b* can be disposed opposite to ground jack contact 114*b* within receptacle 112. Signals on other jack contacts 114 (e.g., functional jack contacts 114*a*, 114*c*, and 114*d*) can be referenced to ground jack contact 114*b*, such that no signal degradation may occur. Alternatively, detect contact 116*b* may be disposed opposite to one of functional jack contacts 114*a*, 114*c*, and 114*d* according to the invention.

Figure 4A:
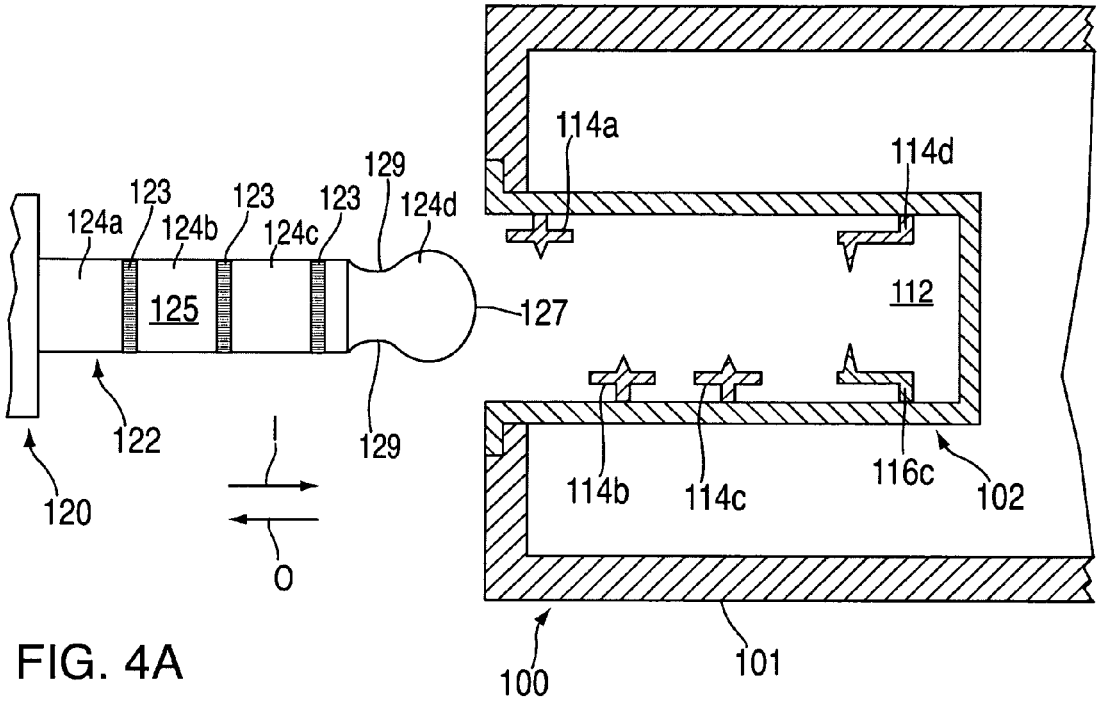
FIGS. 4A and 4B show a portion of the electronic device and accessory component of FIG. 1 in greater detail at various stages of interaction according to yet another embodiment of the invention.
Figure 4B:
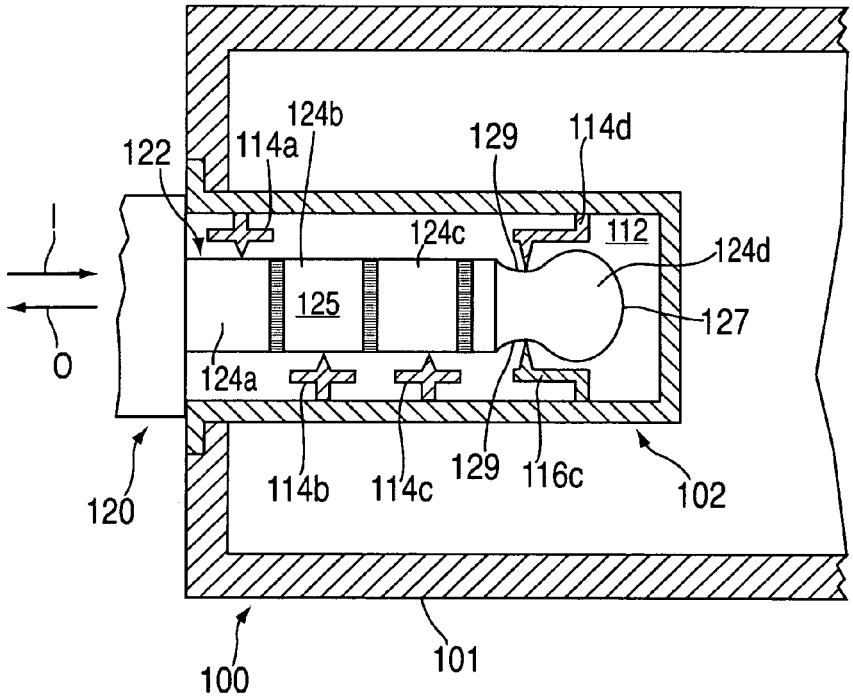

FIGS. 4A and 4B illustrate a plug detection mechanism of electronic device 100 in accordance with yet another embodiment of the invention. In this embodiment, to detect whether plug 122 has been inserted into and is present within receptacle 112 of jack 102, electronic device 100 can include a detect contact 116*c*. Like detect contact 116*b* of FIGS. 3A and 3B, detect contact 116*c* can be located within jack 102 such that one of plug contacts 124 of plug 122 can create a path (e.g., a low impedance circuit path) between detect contact 116*c* and one of jack contacts 114 when plug 122 is inserted into and present within receptacle 112 of jack 102. Body 125 of plug 122, which may be made at least partially of metal or another conductive material, can be used to form plug contacts 124, and can be used to complete the circuit between detect contact 116*c* and a respective jack contact 114.

For example, as shown in FIG. 4B, when plug 122 is inserted into and present within receptacle 112 of jack 102, a circuit signal path may be created through plug 122 (e.g., plug contact 124*d*) and between detect contact 116*c* and jack contact 114*d*. This can cause a signal on detect contact 116*c* to go low (i.e., less than or equal to a predetermined signal value) if, for example, jack contact 114*d* is a ground jack contact. This low signal can then be detected by a control unit of device 100, as described in more detail herein below with respect to FIG. 5. However, in other embodiments, jack contact 114*d* may be a functional jack contact (e.g., a contact configured to pass variable audio signals between electronic device 100 and accessory component 120). The circuit signal path created through plug 122 and between detect contact 116*c* and a functional jack contact 114*d* when plug 122 is present within receptacle 112 may have a relatively higher impedance but may still be a low impedance circuit path. This signal can also be detected by a control unit of device 100, as described in more detail herein below with respect to FIG. 5. However, care may need to be taken such that the functional signal that may be passed by the functional jack contact is not adversely affected when the functional jack contact is also being used as the plug detect mechanism.

Detect contact 116*c* may be positioned within jack 102 and biased such that detect contact 116*c* can rest within an indent 129 along an outer surface of plug 122 when plug 122 has been properly inserted within receptacle 112 of jack 102. Indent 129 may be any suitable size and shape and may be positioned anywhere along the length of plug 122. For example, detect contact 116*c* may include a retention spring that can exert a retention force on indent 129 of plug 122 such that plug 122 may not be withdrawn from receptacle 112 (e.g., in the direction of arrow O) without a user pulling firmly on plug 122. Advantageously, because detect contact 116*c* can act to retain plug 122 within jack 102 as well as to electrically detect the presence of plug 122 within jack 102, detect contact 116*c* is an efficient use of resources within electronic device 100.

Alternatively or additionally, one or more of jack contacts 114 (e.g., jack contact 114*d*, as shown in FIGS. 4A and 4B) may be biased to exert a retention force on plug 122 (e.g., within indent 129 of plug 122) such that plug 122 may not be withdrawn from receptacle 112 (e.g., in the direction of arrow O) without a user pulling firmly on plug 122. Advantageously, because jack contact 114*d* can act to retain plug 122 within jack 102 as well as to electrically communicate with one or more plug contacts 124, a biased jack contact is an efficient use of resources within electronic device 100. It is to be understood that any jack contact 114 of any of the embodiments described above with respect to FIGS. 2A-4B may be biased (e.g., by including a retention spring) to exert a retention force on any portion of plug 122 such that plug 122 may not be withdrawn from receptacle 112 (e.g., in the direction of arrow O) without a user pulling firmly on plug 122.

Figure 5:
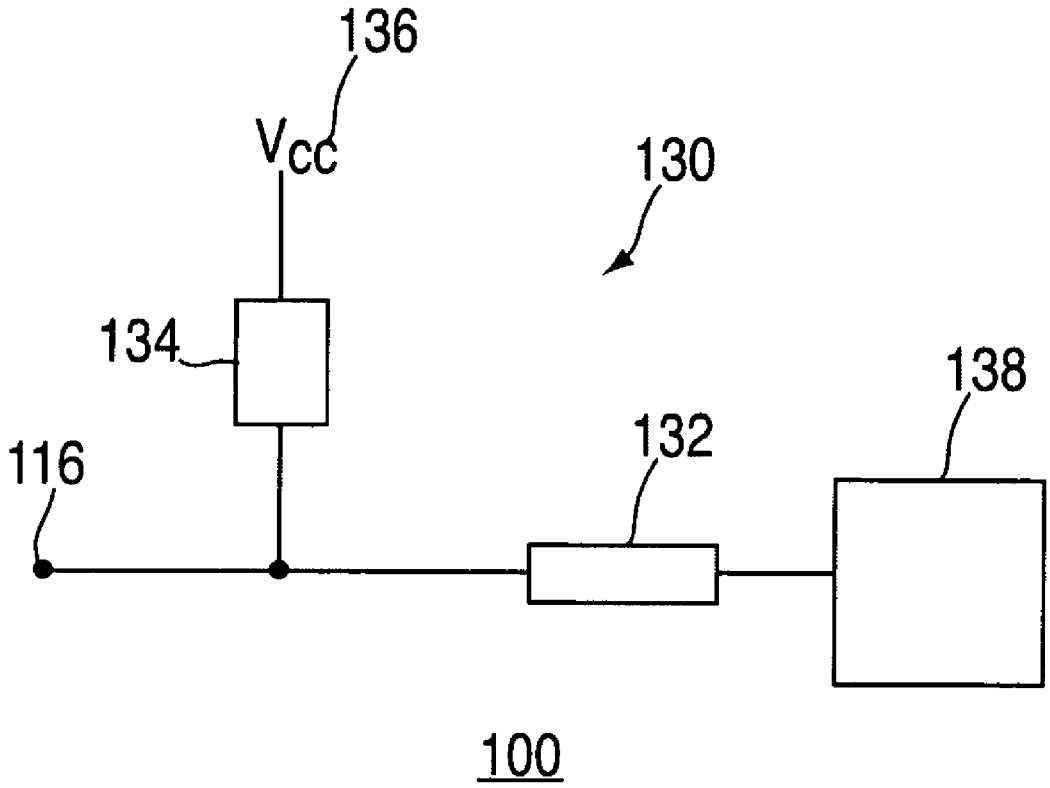
FIG. 5 is a schematic diagram of a portion of the electronic device of FIG. 1 in accordance with the invention.

FIG. 5 illustrates additional control circuitry 130 that may be coupled to one or more detect contacts 116 of jack 102 (e.g. detect contact 116*a*, 116*b*, and/or 116*c*) for detecting the presence of a plug in accordance with the invention. Detect contact 116 can be coupled to a control unit 138 of control circuitry 130. Control unit 138 can be configured to detect the value of a signal on detect contact 116 (e.g., whether the value of the signal is high or low), and can instruct electronic device 100 to behave accordingly.

For example, in the illustrative embodiment of FIGS. 2A and 2B, when control unit 138 detects that the signal on detect contact 116*a* is high, a plug may be assumed to be within receptacle 112 of jack 102 and control unit 138 may instruct electronic device 100 to utilize accessory component 120 by routing input and output audio signals through jack contacts 114 and plug contacts 124 of accessory component 120, as opposed to through, or in addition to through, speaker 108 and microphone 104 of device 100. Likewise, in the illustrative embodiment of FIGS. 3A and 3B, when control unit 138 detects that the signal on detect contact 116*b* is low, a plug may be assumed to be within receptacle 112 of jack 102 and control unit 138 may instruct electronic device 100 to utilize accessory component 120 by routing input and output signals through jack contacts 114 and plug contacts 124 of accessory component 120, as opposed to through, or in addition to through, speaker 108 and microphone 104 of device 100. Control unit 138 can include, for example, a central processing unit ("CPU") of electronic device 100, other suitable digital circuitry, analog circuitry, or any combination thereof.

Additional control circuitry 130 can also include one or more of various additional circuitry components 132, 134, and/or 136 that can be coupled in various ways between control unit 138 and each of the one or more detect contacts 116 of jack 102. For example, as shown in the illustrative embodiment of FIG. 5, additional circuitry component 132 may be a current limiting resistor or network, circuitry component 134 may be a pull-up resistor or resistor network, and circuitry component 136 may be a power source (e.g., $V_{cc}$). In other embodiments, these additional circuitry components 132-136 may be various other types of suitable circuitry components. These additional circuitry components 132-136 may be interposed in various ways between detect contact 116 and control unit 138, as well as between various other contacts of jack 102 (e.g., jack contacts 114) in order to ensure that any signal noise may be minimized and that proper signal properties are protected between detect contact 116 and its one or more associated jack contacts 114 when a plug is present within receptacle 112 of jack 102 and when a plug is not present within receptacle 112 of jack 102 as described above.

While there have been described systems for detecting when a plug of an accessory component is present within a jack of an electronic device, it is to be understood that many changes may be made therein without departing from the scope of the invention. Combinations of embodiments or features in more than one embodiment also are within the scope of the invention. Those skilled in the art will appreciate that the invention can be practiced by other than the described embodiments, which are presented for purposes of illustration rather than of limitation, and the invention is limited only by the claims which follow.

What is claimed is:

1. A plug detect apparatus for detecting the presence of a plug, wherein the plug has at least a first plug contact, the plug detect apparatus comprising:

a receptacle configured to accept the plug;

a first receptacle contact disposed in the receptacle, wherein the first receptacle contact is configured to communicate with the first plug contact;

a detect contact disposed in the receptacle relative to the first receptacle contact so that the presence of the plug within the receptacle creates a signal path through the plug and between the detect contact and the first receptacle contact, wherein the detect contact and the first receptacle contact both contact the same first plug contact when the plug is present in the receptacle; and detection circuitry coupled to the detect contact and the first receptacle contact to detect that the signal path is a low or a high impedance path.

2. The plug detect apparatus of claim 1, wherein the signal path is a low impedance path created by the first receptacle contact and the detect contact.

3. The plug detect apparatus of claim 1, wherein the first receptacle contact is a ground contact.

4. The plug detect apparatus of claim 1, wherein the first receptacle contact is a functional contact.

5. The plug detect apparatus of claim 1, wherein the first receptacle contact is biased to exert a retention force on a first portion of the plug when the plug is present within the receptacle.

6. The plug detect apparatus of claim 5, wherein the first portion of the plug is an indented portion of an outer surface of the plug.

7. The plug detect apparatus of claim 5, wherein the first receptacle contact includes a spring.

8. The plug detect apparatus of claim 1, wherein the detect contact is biased to exert a retention force on a first portion of the plug when the plug is present within the receptacle.

9. The plug detect apparatus of claim 8, wherein the first portion of the plug is an indented portion of an outer surface of the plug.

10. The plug detect apparatus of claim 8, wherein the detect contact includes a spring.

11. The plug detect apparatus of claim 1, wherein any debris in a space between the detect contact and the first receptacle contact is removed from the space between the detect contact and the first receptacle contact by the plug when the plug is inserted into the receptacle.

12. An electronic device capable of detecting the presence of a plug of an accessory component, wherein the plug includes a first plug contact, the electronic device comprising:

a receptacle configured to accept the plug;

a first receptacle contact disposed in the receptacle, wherein the first receptacle contact is configured to communicate with the first plug contact;

a detect contact disposed in the receptacle relative to the first receptacle contact so that the presence of the plug within the receptacle creates a plug signal path through the plug and between the detect contact and the first receptacle contact, wherein the detect contact and the first receptacle contact both contact the same first plug contact when the plug is present in the receptacle; and detection circuitry coupled to the detect contact and the first receptacle contact to detect that the signal path is a low or a high impedance path.

13. The electronic device of claim 12, wherein the electronic device further comprises:

a first input/output component; and control circuitry coupled to the detect contact, wherein the control circuitry is configured to instruct the electronic device to utilize the first input/output component when a detect signal on the detect contact has a first value, and wherein the control circuitry is configured to instruct the electronic device to utilize the accessory component when the detect signal has a second value.

14. The electronic device of claim 13, wherein the plug signal path is configured to make the detect signal have the second value.

15. The plug detect apparatus of claim 12, wherein the plug signal path is a low impedance path.

16. The electronic device of claim 12, wherein the first receptacle contact is one of a ground contact and a functional contact.

17. The electronic device of claim 12, wherein the first receptacle contact is biased to exert a retention force on a first portion of the plug when the plug is present within the receptacle.

18. The electronic device of claim 17, wherein the first receptacle contact includes a spring.

19. The electronic device of claim 12, wherein the detect contact is biased to exert a retention force on a first portion of the plug when the plug is present within the receptacle.

20. The electronic device of claim 19, wherein the detect contact includes a spring.

21. The plug detect apparatus of claim 2, wherein the first plug contact is a metal and the low impedance path has approximately zero resistance.

22. The electronic device of claim 15, wherein the first plug contact is a metal and the low impedance path has approximately zero resistance.

23. The plug detect apparatus of claim 1, wherein the detection circuitry includes circuitry to detect the presence of the plug by detecting that the signal path is a low impedance path.

24. The plug detect apparatus of claim 1, wherein the detection circuitry includes circuitry to detect that the plug is not present in the receptacle by detecting that the signal path is a high impedance path caused by a gap in the signal path.

25. The electronic device of claim 12, wherein the detection circuitry includes circuitry to detect the presence of the plug by detecting that the signal path is a low impedance path.

26. The electronic device of claim 12, wherein the detection circuitry includes circuitry to detect that the plug is not present in the receptacle by detecting that the signal path is a high impedance path caused by a gap in the signal path.

27. The electronic device of claim 12, wherein any debris in a space between the detect contact and the first receptacle contact is removed from the space between the detect contact and the first receptacle contact by the plug when the plug is inserted into the receptacle.

28. The plug detect apparatus of claim 1, wherein the first receptacle contact and the detect contact are biased by a spring to exert a retention force on an indented portion of an outer surface of the plug when the plug is present within the receptacle.

29. The electronic device of claim 12, wherein the first receptacle contact and the detect contact are biased by a spring to exert a retention force on an indented portion of an outer surface of the plug when the plug is present within the receptacle.

* * * * *